US009691366B2

(12) United States Patent
Amos

(10) Patent No.: US 9,691,366 B2
(45) Date of Patent: Jun. 27, 2017

(54) HYBRID DRUM APPARATUS

(71) Applicant: Heather Amos, Ellicott City, MD (US)

(72) Inventor: Heather Amos, Ellicott City, MD (US)

( * ) Notice: Subject to any disclaimer, the term of this patent is extended or adjusted under 35 U.S.C. 154(b) by 0 days.

(21) Appl. No.: 14/544,709

(22) Filed: Feb. 6, 2015

(65) Prior Publication Data

US 2016/0335991 A1 Nov. 17, 2016

(51) Int. Cl.
*G10D 13/02* (2006.01)
*G10D 13/00* (2006.01)

(52) U.S. Cl.
CPC ..... *G10D 13/00* (2013.01)

(58) Field of Classification Search
CPC ..... G10D 13/00; G10D 13/021; G10D 13/08
USPC ..... 84/421
See application file for complete search history.

(56) References Cited

U.S. PATENT DOCUMENTS

| | | | | |
|---|---|---|---|---|
| 2,858,724 | A | 6/1958 | Troppe | |
| 6,198,033 | B1 * | 3/2001 | Lovelett | G10D 13/02 84/411 R |
| 7,482,522 | B2 | 1/2009 | Wening | |
| 7,485,790 | B2 | 2/2009 | Payerl | |
| 7,659,469 | B2 | 2/2010 | Belli | |
| 7,692,083 | B2 | 4/2010 | Aspland | |
| 7,928,303 | B2 | 4/2011 | Millender, Jr. et al. | |
| 8,008,560 | B2 | 8/2011 | Wiese et al. | |
| 8,481,834 | B2 | 7/2013 | Eduardo | |
| 9,087,497 | B1 * | 7/2015 | Krol | G10D 13/02 |
| 9,406,286 | B1 * | 8/2016 | Simonek | G10D 13/025 |
| 2004/0211310 | A1 * | 10/2004 | Hagiwara | G10H 3/146 84/726 |
| 2008/0078279 | A1 * | 4/2008 | Belli | G10D 13/021 84/411 R |
| 2008/0210078 | A1 * | 9/2008 | Millender | G10D 13/021 84/411 M |

(Continued)

OTHER PUBLICATIONS www.themusicshop.net.au/proddetail.
php?prod=Remo+Mondo+Cajon+Drum+with+Texture+Target+-
+CJ-6129-00 2 pages printed from website on Dec. 21, 2016.

(Continued)

*Primary Examiner* — Jeffrey Donels
(74) *Attorney, Agent, or Firm* — Julie A. Krolikowski

(57) ABSTRACT

A hybrid drum apparatus combines and integrates at least two different types of drums into a common apparatus. The hybrid drum apparatus includes a six-sided box drum upon which a player sits and strikes the front and side surfaces to produce various percussion sounds. The box drum body serves as a housing for another type of drum, such as a djembe, which is an elongated goblet-shaped hollow drum, having a membrane drumhead top. The djembe is integrated into the box drum body such both may be played simultaneously. The hybrid drum provides an opening into which the djembe may be inserted such that the drumhead is relatively flush with the strike surface of the box drum. The rear panel of the box drum is provided with an opening which both supports the bottom end of the djembe and allows for the sounds produced to resonate out from the box drum body. The hybrid drum apparatus may incorporate other elongated drums, such as a doumbek or congo, as well as frame drums, such as a flat drum or tambourine. Advantageously, the hybrid drum apparatus may combine and support a variety of drums interchangeably.

20 Claims, 6 Drawing Sheets

(56) References Cited

U.S. PATENT DOCUMENTS

| | | | | |
|---|---|---|---|---|
| 2010/0031802 | A1* | 2/2010 | Millender, Jr. | G10D 13/021 84/411 R |
| 2012/0073420 | A1* | 3/2012 | Schmader | G10D 13/021 84/415 |
| 2014/0041508 | A1* | 2/2014 | Trask | G10D 13/025 84/415 |
| 2016/0253983 | A1* | 9/2016 | Trask | G10D 13/00 |

OTHER PUBLICATIONS www.customdjembecajondrum.com/drum-shop/custom-drums/ 2 pages printed from website on Dec. 21, 2016.
http://kickport.com/cajonport/ 3 pages printed from website on Dec. 21, 2016.
www.x8drums.com/Black-Swan-Drum-p/spbsxx.htm 3 pages printed from website on Dec. 21, 2016.
pearldrum.com/products/percussion/cajons/inner-circle-multi-drum-cajon/ 4 pages printed from website on Dec. 21, 2016.
www.lpmusic.com/products/cajons/angled-surface-cajon/ 1 page printed from website on Dec. 21, 2016.

* cited by examiner

HYBRID DRUM APPARATUS

BACKGROUND

The present embodiments disclosed relate generally to musical instruments and more particularly to a cajon or box drum and other types of percussion instruments.

A cajon is a percussion instrument that originated in Peru. The original cajons were made out of discarded shipping crates. The most common form of the cajon is a cuboid shaped wooden box built to various sizes that is played with the player sitting on the top surface of the cajon and striking the outside of the front panel. A typical cajon has a resonant chamber enclosed by the cajon walls or panels, with an opening or port formed in the back panel for producing bass tones from the resonant chamber. Generally, the opening in the back panel of the cajon body allows for relief of air flow resulting from the cajon being struck by the player, and serves to amplify the sound coming from within the cajon.

Metal strings or snares, attached usually as an option to the inside surface of the striking surface of the front panel, are used to produce a snare sound when the front panel is struck. The cajon walls or panels, because they are relatively thin, operate as vibrating membranes serving the same relative function as a conventional drumhead. Striking a cajon panel or strike panel in different places, e.g. the corners, high or low sections, or the central portion, can thus produce a variety of different and pleasing percussive sounds. To play the cajon, the player typically may use his or her hands, fingers, palms, knuckles and fingernails to produce a multitude of sounds. Mallets, brushes and sticks or any other suitable resilient or hard object may also be used for this purpose. Because a cajon can produce a multitude of drum sounds by striking different areas of the front panel and or side panels of the instrument, and because of its portability, the cajon has grown in popularity. Additionally, the cajon may provide a viable and more cost effective alternative to a drum set.

With the cajon being an integral instrument in Flamenco music and more recently in various other musical styles, the need for a better sounding cajon becomes more apparent. Attempts to improve sound quality have been made in the prior art. For example, U.S. Pat. No. 7,485,790 discloses a cajon with wires attached to the inside wherein each wire acts as a damping element. U.S. Pat. No. 7,482,522 further adds a pedal and snare carpet to change the tone of the instrument. However, there was still a further need for a drum that was capable of producing a deeper bass with more resonance such as produced by a conical or elongated shaped drum with a membrane drumhead and open bottom, in addition to the sound produced by striking wood. Yet it is still desirable to have the design and benefits of a cajon, such as that it may be sat upon while played, and can produce the crisp sounds of the wood panels and snares.

Solutions to these problems have been long sought but prior developments have not taught or suggested any solutions and, thus, solutions to these problems have eluded those skilled in the art. A musical instrument proposed herein solves the problem of having to have multiple separate drum and percussion instruments and accessories to accomplish the same desired variety of combined sounds described above.

SUMMARY

Presented herein, to accommodate the aforementioned need in the art, is a hybrid drum which is a combination of at least two different types of drums, integrated into a common unit or apparatus. The hybrid drum includes a six-sided box drum upon which a player sits and strikes the front and side surfaces to produce various percussion sounds. The box drum of the hybrid drum serves as a housing for another type or types of drums. For example, the hybrid drum also may include a djembe, which is an elongated goblet-shaped hollow drum, traditionally carved from a single piece of hardwood. The djembe has a skin or membrane drumhead top and an open bottom end from which the sound can resonate when the drumhead is struck. The djembe is integrated into the box drum body such that the hybrid drum allows for the playing of multiple drums thereby producing more diverse percussion sounds in one portable and compact unit. The hybrid drum requires less performance space and one less player than usually needed to play the two separate instruments of a box drum and a djembe simultaneously. Because the djembe drumhead and percussion strike surfaces of the box drum are close together in the hybrid drum, combinations of sounds may be made more quickly and effectively. In comparison to a conventional cajon, the hybrid drum provides deeper bass as well as treble sounds produced by drums with skins or membranes, while retaining the higher bass and snare sounds that a cajon offers.

The hybrid drum provides an opening in the front panel of the box drum into which a djembe may be inserted such that the drumhead of the djembe is relatively flush with the strike surface of the front panel of the box drum. Thus both the drumhead of the djembe and the strike surface of the box drum are provided within close proximity in the front panel such that either is easily accessible and strikable by the player with minimal effort. The rear panel of the box drum is provided with an opening which both supports the bottom end of the djembe and allows for the sounds produced by the player striking various areas and surfaces to resonate out from the box drum body.

It is understood that the hybrid drum may utilize other elongated drums instead of the djembe, such as a doumbek, or a congo, for example, which would be supported inside the box drum body in the same manner as the djembe embodiment. Furthermore shorted-bodied drums, for example a snare drum, could be inserted into the front opening, with no need for a base support. It is advantageous that the hybrid drum apparatus can combine and support a variety of drums as described, interchangeably.

One embodiment provides for a hybrid drum apparatus integrating multiple drums into one unit. A first drum is provided with a first drum body and a resonant chamber disposed within the drum body. A seating area may be provided on a top of the first drum body upon which a player may be seated. At least one strike surface is provided on the first drum body which a player may strike to produce sounds. A sound hole may be provided in the first drum body from which sounds from the resonant chamber emit upon a player striking any strike surface of the first drum body. An opening may be disposed in one strike surface of the first drum body, with the opening being distinct from the sound hole.

In an aspect of the embodiment, a second drum having a second drum body may be inserted into the first drum body through the opening, with a drum head remaining exposed outside of the first drum body and protruding from the opening, such that a player sitting on the seating area is able to strike the drum head of the second drum and any strike surface on the first drum body simultaneously.

Advantageously, one aspect provides that the second drum is removably inserted into the opening in the first drum body such that a third drum may be interchangeable with the second drum.

In one aspect, an embodiment provides that one or more snare wire sets or other components may also be installed in an upper portion on an inside of the front surface of the box drum, above the opening therein, to provide for even more percussive sound options.

Advantageously, an embodiment provides that the front panel of the box drum body be angled, thereby providing a larger strike surface as well as being more ergonomic for the player.

One feature of the box drum body provides that rear opening is larger than the base of the djembe for the purpose of resonating sounds emitting from the box drum body. In a particular embodiment the rear opening is formed in the shape of a keyhole or a hollow eight.

In one aspect, an embodiment takes advantage of the available space of the side panels of a box drum, by having textured applications installed externally on the box drum's strike panels for producing a range of unique and varied percussive sounds.

In another aspect, an embodiment takes advantage of the available space of the side panels to attach a variety of accessories capable of providing even more percussion sounds. Advantageously, the attached accessories are conveniently accessible to the player, being within arms reach.

Accordingly, one skilled in the relevant art will appreciate that the concepts disclosed herein apply to a wide variety of combinations, in addition to the specific styles discussed herein and depicted in the accompanying figures.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The present embodiments can be better understood with reference to the following drawings and description. The components in the figures are not necessarily to scale, emphasis instead being placed upon illustrating the principles of the embodiments disclosed. Moreover, in the figures, like reference numerals designate corresponding parts throughout the different views. In the drawings.

DETAILED DESCRIPTION

The following discussion and accompanying figures disclose exemplary embodiments of a hybrid drum apparatus and system, combining two or more percussion components into an integrated unit.

Figure 1:
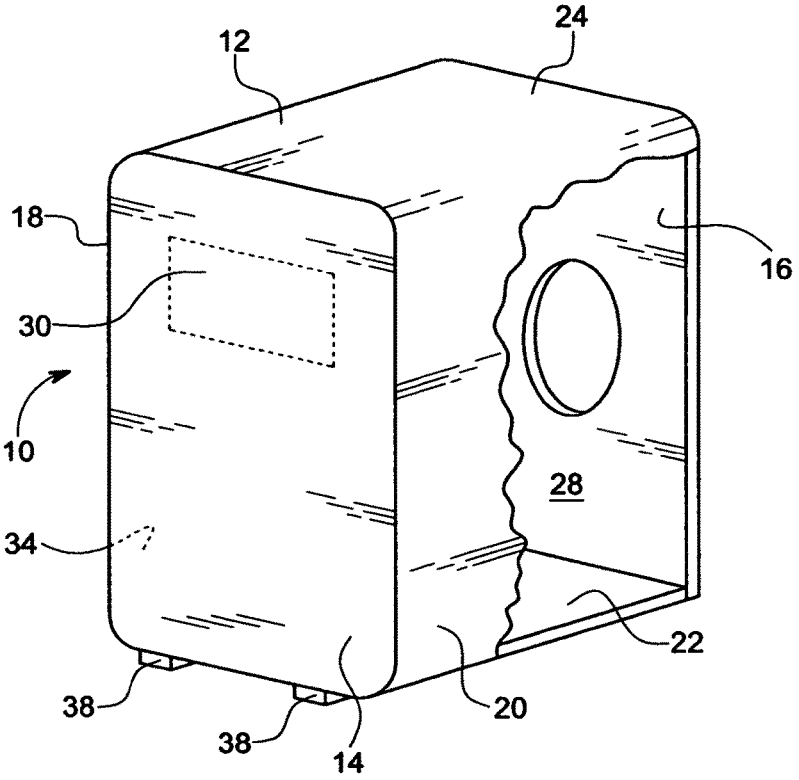
FIG. 1 is a perspective view of a traditional cajon having a side panel partially cut away to reveal the interior.

FIG. 1 shows a generic type of a cajon or box drum, known in the art. Cajon 10 includes a generally cuboid shaped cajon body 12, having front panel 14, back panel 16, first side panel 18 and second side panel 20 (shown cut away so as to view the interior of cajon body 12). Cajon body 12 further includes bottom panel 22 and top panel 24, where top panel 24 functions as a seat for a player (not shown). Front panel 14, back panel 16, first side panel 18, second side panel 20, bottom panel 22, and top panel 24 are integrally joined to form cajon body 12. The outer surface area or strike surface 26 of front panel 14 may be struck by a hand of a player to achieve an audible effect. Inside cajon body 12 is resonant chamber 28, which may include one or more sets of snare wires 30 on interior surface 34 of front panel 14. Formed within back panel 16 is opening 36 which enables the production of bass sounds and functions as a resonating sound hole. Cajon body 12 is supported by feet 38. The front panel of a typical cajon is most commonly constructed of wood ply, roughly ⅛" to ¼" in thickness, where the outer surface area is struck by the hand of the cajon player to achieve an audible effect. The front panel is normally mounted to the cajon body using screws.

Typically a cajon is played with a player in a seated position on top of the cajon and with the body being straddled between the player's legs. The player, sitting upright, strikes the vertical strike surface with his or her hands in a generally vertical and downward position, as depicted.

Figure 2:
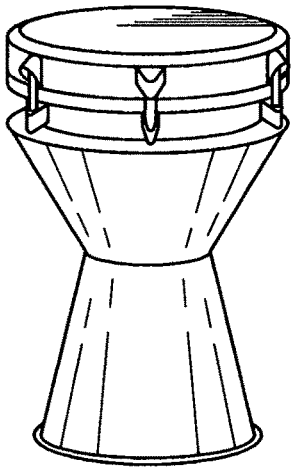
FIG. 2 is a perspective view of a djembe.

FIG. 2 shows a djembe, which is an instrument known in the art. The djembe has a hollow, goblet-shaped body, with a membrane or skin as a drumhead. Typically the djembe is played in an upright position, as shown in the drawing, with a player in a seated position with the body between the player's legs. The player, sitting upright, strikes the horizontal drumhead with his or her hands in a generally horizontal position, as depicted. It will be easily understood by those familiar with percussion instruments that it would be most difficult for a single player to simultaneously play both a cajon and a djembe, while effectively producing quality desired sounds for both instruments. Hence, a hybrid drum apparatus and system is presented hereinafter.

Figure 3:
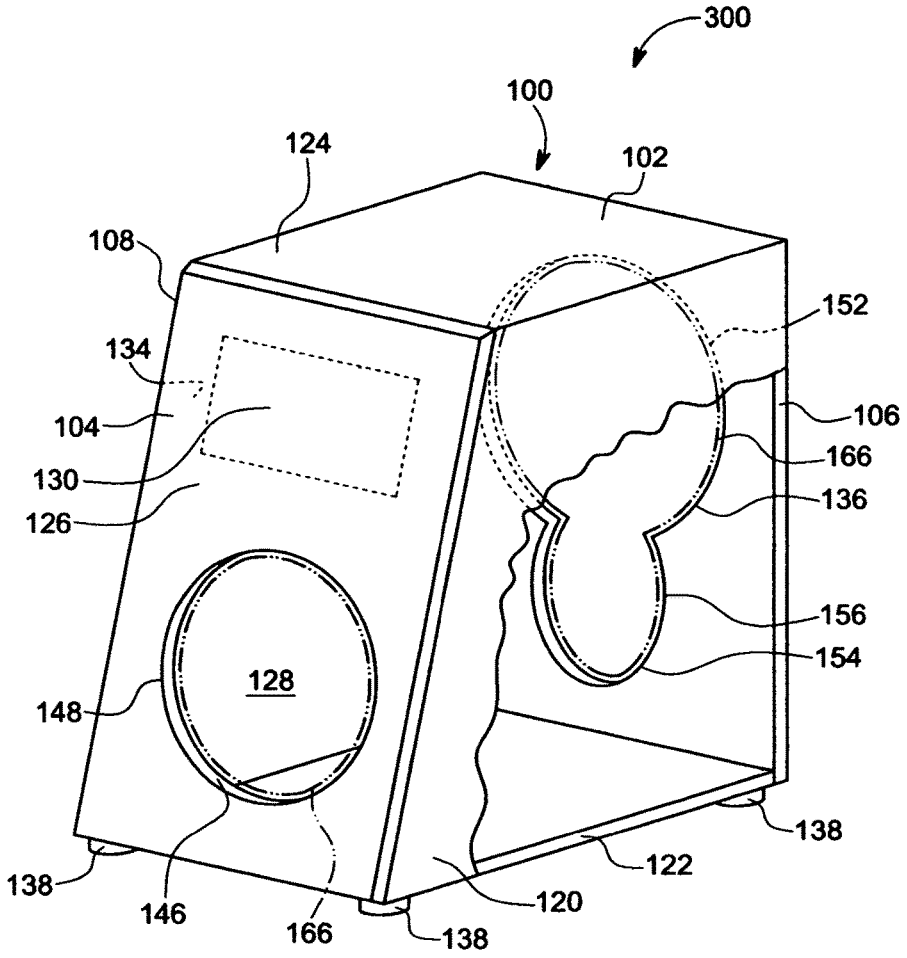
FIG. 3 is a perspective view of an embodiment of a box drum component of hybrid drum apparatus.

FIG. 3 illustrates an exemplary embodiment of a first component 300 of a hybrid drum apparatus featuring a novel box drum. Box drum 100 includes a six-sided box drum body 102 having front panel 104, back panel 106, first side panel 108, and second side panel 120. Second side panel 120 is shown partially cut away so as to view an interior of box drum body 102. Box drum body 102 further includes bottom panel 122 and top panel 124 with top panel 124 functioning as a seat for a player (not shown). Front panel 104, back panel 106, first side panel 108, second side panel 120, bottom panel 122, and top panel 124 are integrally joined to form box drum body 102. In one embodiment, box drum body 102 may have a 12" length×12" width top panel, a 17" length×12" depth bottom panel, and 19" height side panels.

However it will be understood that these dimension are merely exemplary and may be varied to suit a players' size, for example.

The outer surface area of front panel 104 provides strike surface 126 which may be struck by a hand of the player (not shown). Inside box drum body 102 is resonant chamber 128. In some embodiments, resonant chamber 128 may include one or more vibrating components on interior surface 134 of front panel 104, opposing strike surface 126. Shown generically as element 130, the one or more vibrating components may include snare wires, sound string or cords, sound beads, etc. In some embodiments, front panel 104 may be angled as depicted, such that bottom panel 122 of box drum body 102 is longer from back to front than top panel 124, thereby providing a larger playing area compared to a vertical front panel, as well as being more ergonomic for the player. In some embodiments, front panel 104 may be more or less angled compared to the embodiment shown. Box drum body 102 may be supported on feet 138 as shown, for example, or by any suitable means to elevate box drum body 102 from the floor, if desired.

In the exemplary embodiment, shown in FIG. 3, front panel 104 may be provided with a large, generally circular opening, hereinafter front panel opening 148. Front panel opening 148, may be disposed in a lower portion 154 of front panel 104, closer to bottom panel 122 than top panel 124, and below vibrating element 130. Back panel 106 may be provided with a large key-hole shaped opening, for example, hereinafter back panel opening 136. Back panel opening 136 allows for sounds to emit and resonate from resonant chamber 128 inside box drum body 102. Back panel opening 136 in the depicted embodiment, has two generally circular portions, upper portion 152 and lower portion 154. Upper portion 152 of back panel opening 136 may have a larger diameter than lower portion 154 of back panel opening 136. Although upper portion 152 and lower portion 154 are described as circular and as having diameters, this does not necessarily require that their shapes be true circles.

In some embodiments, the shapes of front panel opening 148 and the back panel opening 136 may have alternate shapes and sizes so as to accommodate different shapes and sizes of components of the hybrid drum to be integrated with box drum body 102 of the hybrid drum. Furthermore, box drum body 102 may also be produced in other geometric configurations, for example octagonal, pentagonal, rectangular, triangular, hexagonal, heptagonal, conical, and round, and may formed employing individual pieces or panels integrally joined to fashion the instrument, or a single continuous piece or panel as required (not shown). Individual pieces of panels may be joined together by adhesives, clamps, nails, screws, or other methods. In some embodiments, the box drum body 102 may be fabricated of a variety of materials, including, without limitation, wood, MDF, fiberglass, molded plastic, sheet metal and plastic sheets. Such variations in the abovementioned features are provided as needed, for example to accommodate other components of a hybrid drum apparatus and system in a box drum body, to be described hereinafter.

In some embodiments, peripheral edge 146 of front panel opening 148 may be provided with flange or front panel opening lip 166 (shown in phantom). Front panel opening lip 166 may line or cover peripheral edge 146 with protective material, such as foam rubber, plastic, etc. Similarly, peripheral edge 156 of back panel opening 136 may be provided with flange or back panel opening lip 168 (shown in phantom). Front panel opening lip 166 and back panel opening lip 168 are provided to protect the outer surfaces of a component, to be described hereinafter, which may be inserted into or through front panel opening 148 or back panel opening 136. Furthermore, front panel opening lip 166 and back panel opening lip 168 serve as a means to hold an inserted component securely in place, preventing slipping, sliding, and rotation of the component relative to box drum body 102. In other drawings, the protective lip may be omitted for simplicity although the feature may be provided in any embodiment, such as shown in FIG. 8.

Figure 4:
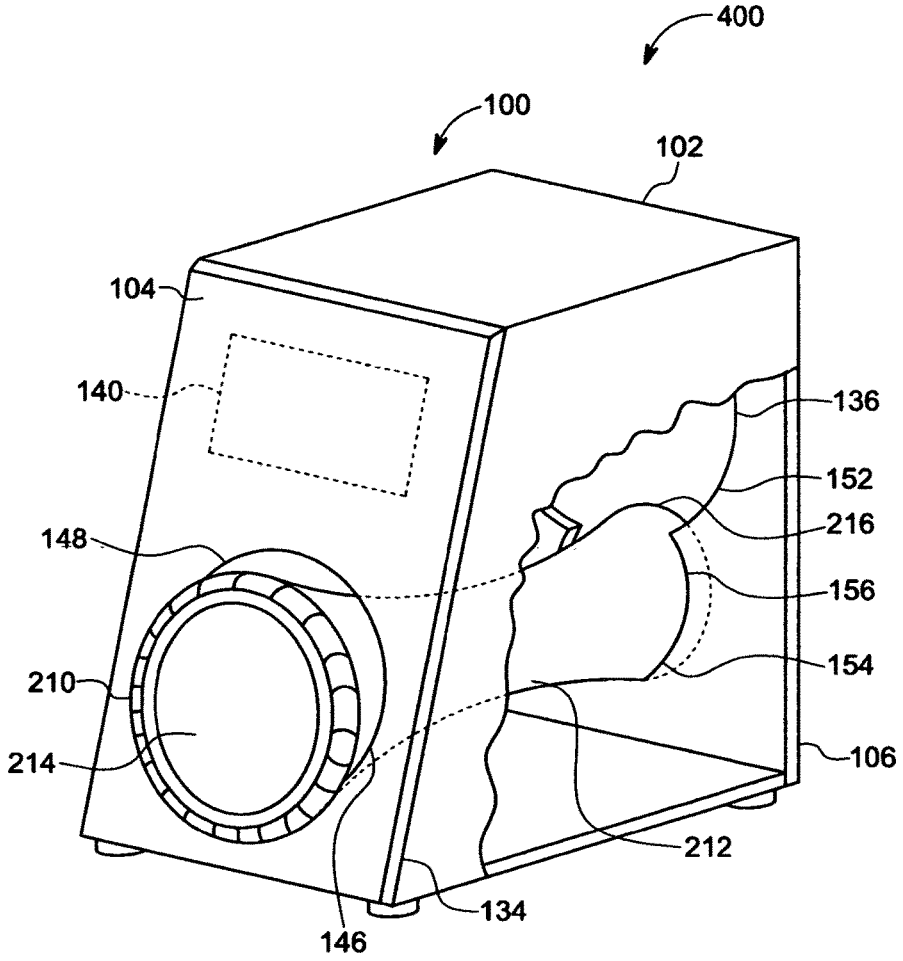
FIG. 4 is a perspective view of a first embodiment of a hybrid drum apparatus having an elongated drum disposed inside of a box drum, and having a side panel partially cut away to reveal the interior.

FIG. 4 illustrates an exemplary embodiment of a hybrid drum apparatus 400 featuring an integrated unit having an elongated drum supported within a novel box drum. Djembe 210, having goblet-shaped body 212 with drumhead 214 and base end 216, is integrated into box drum body 102. It should be noted that djembe 210 represents any type of djembe, such as the djembe shown in FIG. 2, or a traditional rope tightened djembe, for example. Djembe 210 further is representative of other similarly shaped drums, including for example a doumbek.

Front opening 148 in front panel 104 of box drum body 102 provides a space through which djembe may be inserted base end first, such that drumhead of djembe is relatively flush with strike surface 126 of front panel 104 of box drum body 102. Thus both drumhead 214 of djembe 210 and strike surface 126 of box drum body 102 are provided within close proximity in front panel 104 of box drum body 102 such that either is easily strikable by the player. In one embodiment, an optional vibrating component, such as snare wires 140, may be installed in an upper part of interior surface 134 of front panel 104 of box drum body 102, above front panel opening 148 therein for djembe 210. In such an embodiment, a player has the ability to produce at least three distinct percussive sounds from the front panel, in and of itself, of hybrid drum apparatus 400.

Back panel 106 of box drum body 102 is provided with back panel opening 136 which supports base end 216 of djembe and also allows for the sounds produced by the player striking various areas and surfaces to resonate. Back panel opening 136 is larger than base end 216 of djembe for the purpose of resonating sounds. Upper portion 152 of back panel opening 136 is depicted as being larger than lower portion 154. Upper portion 152 may accommodate the extreme end of base end 216 of djembe, which tapers outward from the middle of goblet-shaped body 212 toward base end 216. In the case where base end 216 may be wider than lower portion 154 of back panel opening 136, when integrating djembe with box drum body 102, base end 216 may be inserted through upper portion 152 of back panel opening 136, which is shown as being larger than the extreme end of base end 216. Then the base end 216 may be lowered into lower portion 154 of back panel opening 136 to be supported therein.

In some embodiments, peripheral edge 146 of front panel opening 148 and peripheral edge 156 of back panel opening 136 may be lined or covered with protective material (not shown), such as foam rubber, plastic, etc, which may protect the outer surfaces of the djembe as well as serve as a means to hold the djembe securely in place, preventing slipping, sliding, and rotation of the djembe relative to the box drum body 102.

In some embodiments, as an alternative to a djembe, any drum with an 8"-10" head may be removably inserted into the front opening of the box drum body, such as a doumbek, junior congas, or snare drums. Furthermore, the back opening in the box drum body 102 may accommodate frame drums or wood panels, as well and a resonant member if desired. In a particular embodiment the rear opening is formed in the shape of a hollow eight or keyhole. Examples of drums and other inserts such as an African Djembe, Middle Eastern Doumbek, Afro-Cuban Conga, Japanese Shime Daiko, and resonant members, which may be included in some aspects of some embodiments of the present application, are disclosed in U.S. Pat. No. 7,659,469, issued February, 2010 to Belli, and entitled "PITCH MODULATOR DRUM," the entirety of which is hereby incorporated by reference.

Figure 5:
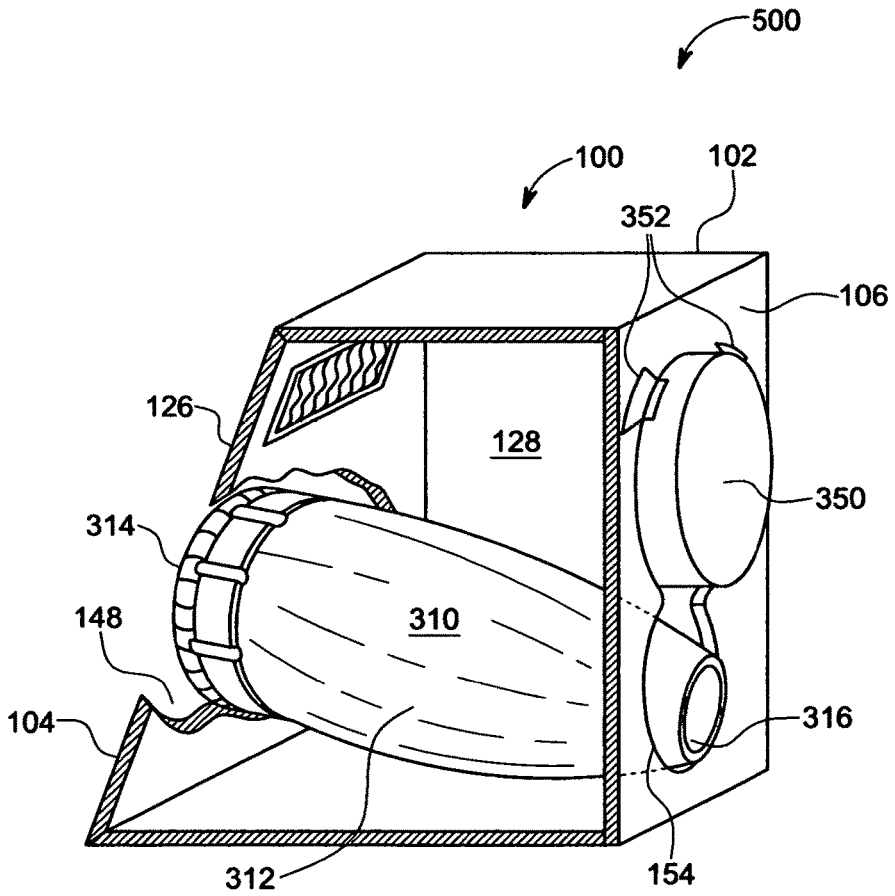
FIG. 5 is a perspective, cross-sectional view of a second embodiment of a hybrid drum apparatus shown from the side and rear.

FIG. 5 illustrates an exemplary embodiment of a hybrid drum apparatus 500 featuring a different type of elongated drum supported within the box drum body 102 described above. However, instead of a djembe, conga 310 having elongate body 312 with drumhead 314 and base end 316 is integrated with box drum body 102 in a similar manner. Front panel opening 148 of box drum body 102 provides a space through which conga 310 may be inserted into, base end 316 first, such that when in a proper resting position, drumhead 314 of conga 310 is relatively flush with strike surface 126 of front panel 104, while lower portion 154 of back panel opening 136 (not visible) supports base end 316 of conga 310. Thus both drumhead 314 of conga 310 and strike surface 126 of front panel 104 of box drum body 102 are provided within close proximity in the front panel 104 such that either is easily strikable by the player.

In one embodiment, depicted in FIG. 5, circular frame drum 350 may be disposed within upper portion 152 (not visible) of back panel opening 136. Frame drum 350 is shown generically in the drawing for simplicity. It will be understood that any variety of frame drum is represented by frame drum 350. Securing member or members 352, to be described further hereinafter with reference to FIG. 6, may be provided to secure frame drum 350 to upper portion 152 of back panel opening 136.

Figure 6:
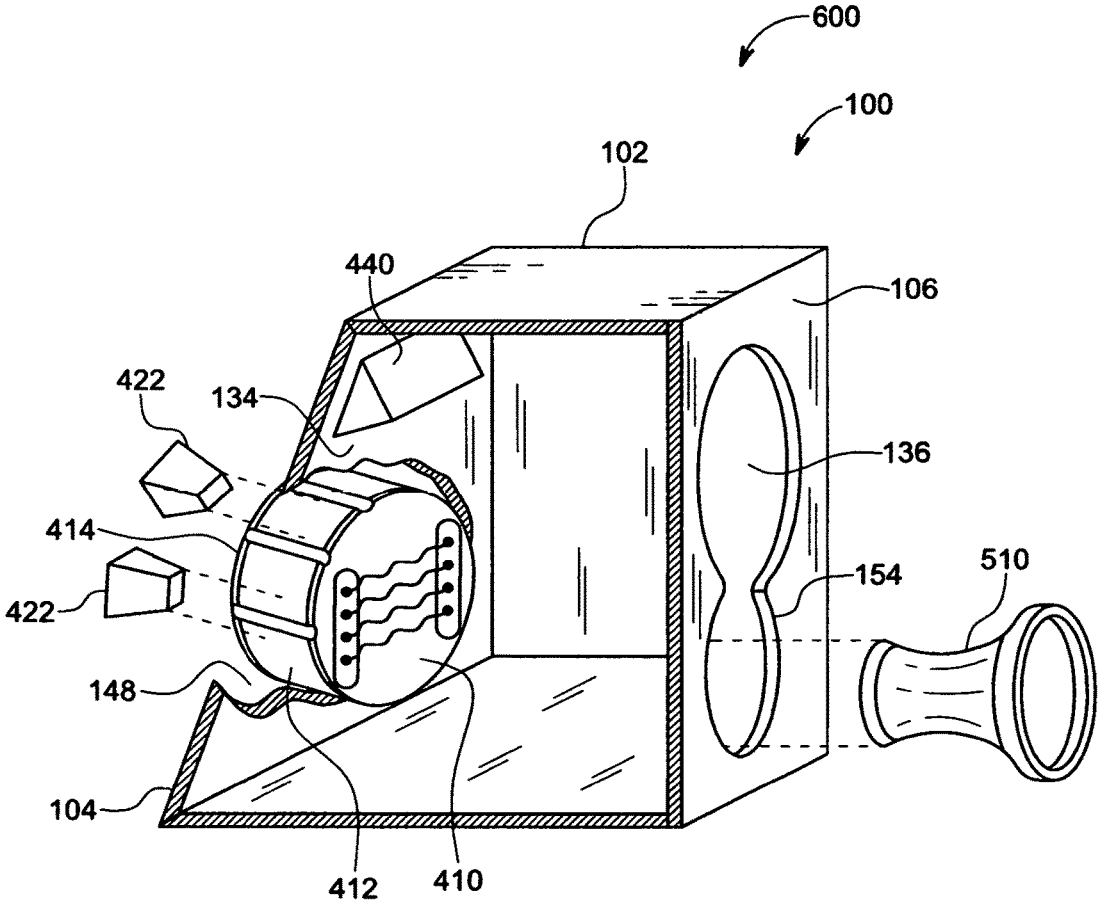
FIG. 6 is a perspective, cross-sectional view of a third embodiment of a hybrid drum apparatus shown from the side and rear.

FIG. 6 illustrates an exemplary embodiment of a hybrid drum apparatus 600 featuring yet another different drum and component integrated within the box drum body 102 described above. However, instead of a djembe or a conga which both have an elongate body, a frame drum is integrated into box drum body 102. In one embodiment, snare drum 410 having frame 412 and drum head 414 may be inserted into front panel opening 148 of box drum body 102. Snare drum frame 412 may be inserted into and supported by front panel opening 148, such that drumhead 414 is relatively flush with strike surface 126 of front panel 104. Thus both drumhead 414 of snare drum 410 and strike surface 126 of front panel 104 of box drum body 102 are provided within close proximity in front panel 104 such that either is easily strikable by the player.

In some embodiments, snare drum 410 or any frame drum disposed in front panel opening 148 may be secured in front panel opening 148 by any suitable securing member or members. Securing member or members may be provided on frame drum and/or in or around front panel opening 148 in order to securely retain the frame drum within the front panel opening 148. Such mechanisms may include, for example, Velcro™-type closures, rubber gaskets, clamps, elastic cords, hooks, foam or plastic inserts or wedges, etc., which may be used alone or in any combination. For simplicity in the drawings, securing member or members are represented only generically by elements 422. Elements 422 in the depicted embodiment may be formed as foam rubber wedges, which may be inserted between snare drum 410 and front panel opening 148 to secure snare drum in the front panel opening.

In one embodiment, depicted in FIG. 6, resonant member 510 may be disposed within lower portion 154 of back panel opening 136. Types of resonant members include tubular members of varying shapes and lengths, such as Kickport® sound enhancers. Although not explicitly shown, securing member or members such as described above may be similarly provided for securing any components, including resonant member 510, in back panel opening 136, if needed.

In some embodiments, a vibration device 440 is provided on interior surface 134 of front panel 104, as shown in FIG. 6. Vibration device 440 may have an interior filled with sound beads, for example, to provide additional percussive sounds when strike surface 126 is struck. Vibration device 440 may be used alone or in combination with snare wires 140 as previously described and/or with other mechanisms.

Figure 7:
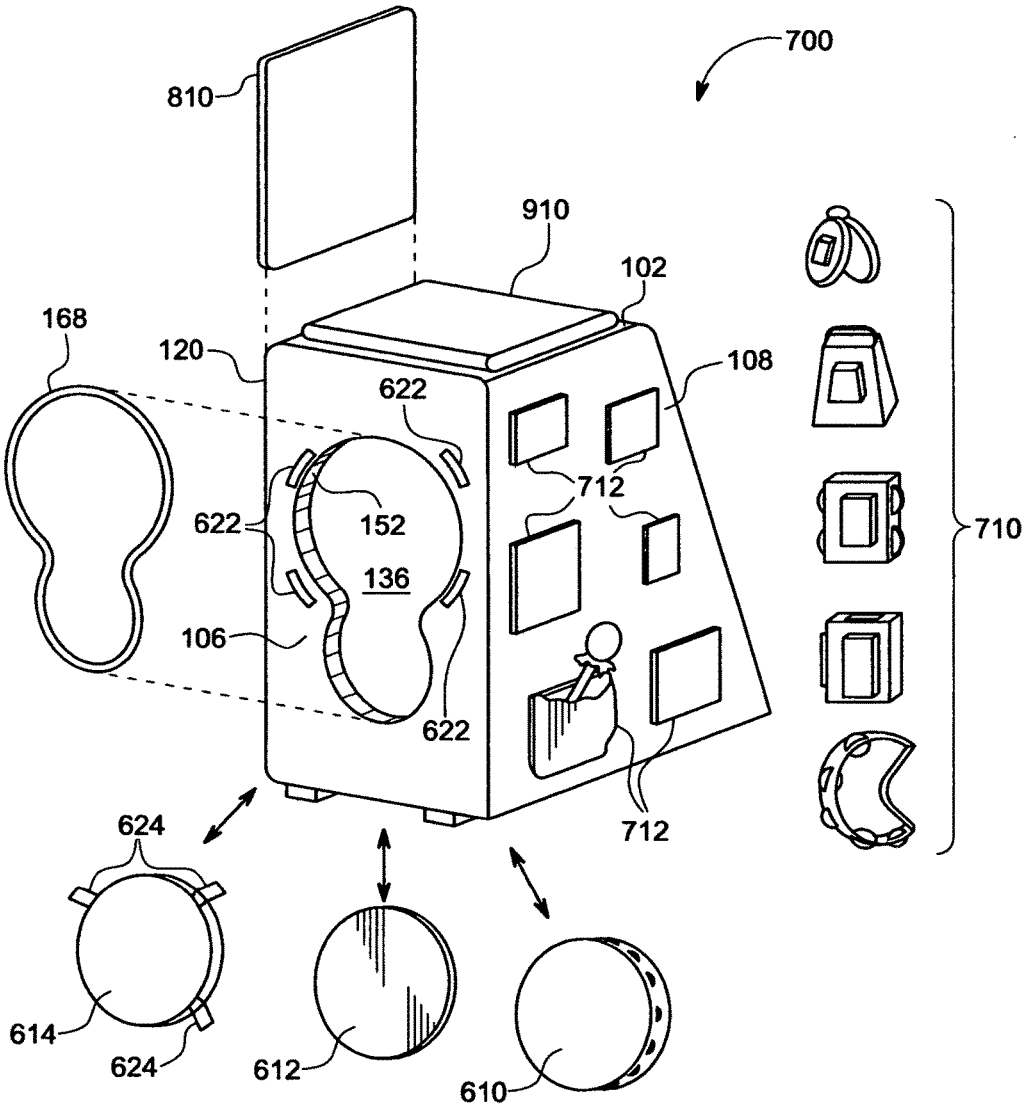
FIG. 7 is an exploded perspective view of other combinations for a hybrid drum apparatus, shown from the side and rear.

FIG. 7 illustrates an exemplary embodiment of a hybrid drum apparatus 700 featuring a system for integrating a variety of components with the box drum body 102 described above. In the forefront of the drawing, three exemplary frame drums or panels, tambourine 610, wood panel 612, and flat skin-head drum 614, are depicted as optional, interchangeable components. In some embodiments, for example, tambourine 610 may be removably attached to upper portion 152 of back panel opening 136, as indicated by an arrow. Tambourine 610, when disposed on back panel opening 136, may be secured to back panel 106 by any suitable securing member or members. Securing member or members, such as described previously with respect to FIG. 6, may be similarly provided for securing any components on upper portion 152 of back panel opening 136. Securing member or members may be provided on a frame drum, such as tambourine 610, and/or in or around back panel opening 136. For simplicity in the drawings, securing member or members are represented only generically by elements 622 on back panel 106 of box drum body 102, and by elements 624 on skin-head drum 614, as an example.

In one embodiment, as viewed from the back of box drum body 102, back panel opening 136 is shown having back panel opening lip 168 to be applied around peripheral edge 156 thereof. Back panel opening lip 168 was described earlier herein with respect to FIG. 3, and as such any further explanation thereof is omitted.

FIG. 7 further illustrates a system for interchangeably attaching accessories to the outside of box drum body 102. In one embodiment, a variety of accessory components 710 are shown in a representative group. Accessory components 710 may include hand shakers and jingles, foot jingles, castanets, woodblocks, cabasas, cowbells, small snares, frame drums, tambourines, riqs, cymbals, kick pedals, etc.

In some embodiments, first side panel 108 of box drum body 102 may have one or more accessory holders 712. Accessory holders 712 disposed on first side panel 108 may be secured to first side panel 108 by any suitable means. Accessory holders 712 may include, for example, pockets, hooks, Velcro™-type closures, elastic cords, etc., which may be used alone or in any combination. For simplicity in the drawings, accessory holders are represented only generically by attaching members 722 provided on first side panel 108. Complementary attachment members 724, also shown generically, may be provided on one or more of the accessory components 710, as needed. It will be understood that accessory components may be attached to any of front panel 104, first side panel 108, second side panel 120, top panel 124 and/or back panel 106.

In one embodiment, texture surface 810 may be provided on second side panel 120. It will be understood that one or more textured surface 810 may be attached to any of front panel 104, first side panel 108, second side panel 120, top panel 124 and/or back panel 106. Textured surface 810 may include polyester, fabric, brush material, sponge material, foam material, a silkscreened image, film material, resin, sandpaper material, sandblasted material, etc. Also provided in one embodiment may be a seating surface 910 which can be any suitable material, thickness, size, etc.

While various embodiments have been described, the description is intended to be exemplary, rather than limiting and it will be apparent to those of ordinary skill in the art that many more embodiments and implementations are possible. Accordingly, the embodiments are not to be restricted except in light of the attached claims and their equivalents. Also, various modifications and changes may be made within the scope of the attached claims.

What is claimed is:

1. A hybrid drum apparatus integrating multiple drums into one unit, comprising:

a first drum having a first drum body and a resonant chamber disposed within the drum body;

a seating area provided on a top of the first drum body upon which a player may be seated;

at least one strike surface provided on the first drum body which a player may strike to produce sounds;

a sound hole provided in the first drum body from which sounds from the resonant chamber emit upon a player striking any strike surface of the first drum body;

an opening disposed in one strike surface of the first drum body, the opening being distinct from the sound hole; and a second drum having a second drum body, the second drum body being inserted into the first drum body through the opening, the second drum having a drum head remaining exposed outside of the first drum body and protruding from the opening, such that a player sitting on the seating area is able to strike the drum head of the second drum and any strike surface on the first drum body simultaneously.

2. The apparatus according to claim 1, wherein:

the first drum is a box drum having at least a top panel, a front panel, and a back panel, with the seating area being disposed on the top panel, the sound hole being disposed in the back panel, and the opening being disposed in the front panel;

the second drum body having an elongated shape and a base end which is inserted through the opening in the front panel of the first drum body; and the drum head being supported in the opening while the base end of the second drum is supported in a portion of the sound hole in the back panel of the first drum body.

3. The apparatus according to claim 2, wherein the front panel of the first drum body is angled in a manner such that the front panel angles outward from the top panel to the bottom panel.

4. The apparatus according to claim 1, wherein the second drum is removably inserted into the opening in the first drum body such that the second drum may be removed from the opening and another drum may then be inserted into the opening in place of the second drum interchangeably.

5. The apparatus according to claim 1, wherein the first drum is a cajon and the second drum is a djembe, a doumbek, a conga, or a snare drum that can be interchangeably inserted into the cajon through the opening in the first drum body.

6. The apparatus according to claim 2, wherein the first drum is a cajon and the second drum is a djembe, a doumbek, or a conga that can be interchangeably inserted into the cajon through the opening in the first drum body and supported at the base end.

7. The apparatus according to claim 2, wherein the sound hole disposed in the back panel of the box drum has an upper portion and a lower portion, the upper portion being larger than the lower portion such that the base end of the second drum is able to pass through the upper portion of the opening and then be lowered into the lower portion of the opening to be supported therein.

8. The apparatus according to claim 7, wherein the sound hole has a keyhole shape or an "8" shape.

9. The apparatus according to claim 1, wherein a circumference of the opening provided in the first drum body and a circumference of the sound hole provided in the first drum body may have a protective material disposed at least partially thereon.

10. The apparatus according to claim 1, further including accessory components which may be attached to the first drum body by attachment members provided on the first drum body, thereby providing a player access to the accessory components.

11. The apparatus according to claim 1, further including a third drum component disposed over a portion the sound hole, and securing members which may be disposed around the sound hole and on the third drum component thereby securing the third drum component to the first drum body.

12. The apparatus according to claim 11, wherein the third drum component is a tambourine, a wood panel, or a flat skin-head drum.

13. The apparatus according to claim 1, further including a resonant member disposed within at least a portion the sound hole in the first drum body, which resonant member enhances sound emitting from the resonant chamber.

14. The apparatus according to claim 1, further including a vibration device provided on an interior surface of the one strike surface having the opening therein.

15. The apparatus according to claim 14, wherein the vibration device includes one or more snare wire sets or other components installed in an upper portion of the one strike surface, above the opening therein.

16. A hybrid drum apparatus and system for incorporating a combination of at least two different types of drums integrated into a common unit, comprising:

a six-sided box drum upon which a player sits and strikes a front surface and side surfaces to produce various percussion sounds, the box drum of the hybrid drum serving as a housing for one or more additional drums;

an opening provided in the front surface for supporting a second drum therein;

a second drum having an elongated body and a drum head, the elongated body of the second drum being inserted into and supported by the opening in the front surface of the box drum such that the box drum houses the elongated body of the second drum, while the drum head of the second drum being substantially flush with the front surface of the box drum such that the player can strike the drum head of the second drum and the front surface or side surfaces of the box drum simultaneously.

17. The hybrid drum apparatus and system according to claim 16, wherein the box drum has a sound hole in a back surface opposite the front surface thereof, the sound hole being large enough to support a base end of the elongated body of the second drum, and resonate sound emitting from inside the box drum while being played.

18. The hybrid drum apparatus and system according to claim 17, wherein the front surface of the box drum is angled in a manner such that the front surface angles outward from a top surface to a bottom surface.

19. The hybrid drum apparatus and system according to claim 17, wherein the sound hole has a keyhole shape or an "8" shape.

20. The hybrid drum apparatus and system according to claim 16, wherein the second drum is removably inserted into the opening in the front surface of the box drum such that the second drum may be removed from the opening and another drum may then be inserted into the opening in place of the second drum interchangeably.

* * * * *